US005418541A

United States Patent [19]

Schroeder et al.

[11] Patent Number: 5,418,541

[45] Date of Patent: May 23, 1995

[54] PLANAR, PHASED ARRAY ANTENNA

[75] Inventors: Gerry B. Schroeder; Larry T. Davis, both of Fountain Hills, Ariz.

[73] Assignee: Schroeder Development, Fountain Hills, Ariz.

[21] Appl. No.: 224,827

[22] Filed: Apr. 8, 1994

[51] Int. Cl.[6] ..... H01Q 1/38

[52] U.S. Cl. ..... 343/700 MS; 343/770

[58] Field of Search ..... 343/700, 770, 778, 846; H01Q 1/38

[56] References Cited

U.S. PATENT DOCUMENTS

| | | | |
|---|---|---|---|
| Re. 29,911 | 2/1979 | Munson | 343/700 MS |
| 3,587,110 | 6/1971 | Woodward | 343/813 |
| 4,191,959 | 3/1980 | Kerr | 343/700 |
| 4,410,891 | 10/1983 | Schaubert et al. | 343/700 MS |
| 4,686,535 | 8/1987 | Lalezari | 343/700 MS |
| 4,713,670 | 12/1987 | Makimoto et al. | 343/700 MS |
| 4,816,835 | 3/1989 | Abiko et al. | 343/700 MS |
| 4,829,309 | 5/1989 | Tsukamoto et al. | 343/700 MS |
| 4,857,938 | 8/1989 | Tsukamoto et al. | 343/700 MS |
| 4,914,445 | 4/1990 | Shoemaker | 343/700 MS |
| 4,937,585 | 6/1990 | Shoemaker | 343/700 MS |
| 5,223,848 | 6/1993 | Rammos et al. | 343/700 MS |
| 5,270,721 | 12/1993 | Tsukamoto et al. | 343/700 MS |
| 5,278,569 | 1/1994 | Ohta et al. | 343/846 X |

*Primary Examiner*—Donald Hajec
*Assistant Examiner*—Tho G. Phan
*Attorney, Agent, or Firm*—Cahill, Sutton & Thomas

[57] ABSTRACT

A planar, phased array antenna includes a ground plate, a signal plate having a plurality of active elements and conductive branches electrically connecting said active elements in mirror symmetrical pairs, an aperture plate having a plurality of apertures oriented in the same direction and aligned with said active elements to provide electromagnetic coupling between each active element and the corresponding aperture, and spacers between the plates. The ground plate is formed on a first spacer, e.g. by screen printing, and the aperture plate is formed on the other spacer, e.g. by screen printing. The signal plate includes an insulating substrate and a patterned conductive layer on said substrate. Alternatively, the aperture plate is separate from the other spacer and includes an insulating substrate and a patterned conductive layer on the substrate.

6 Claims, 3 Drawing Sheets

PLANAR, PHASED ARRAY ANTENNA

BACKGROUND OF THE INVENTION

This invention relates to phased array antennas and, in particular, to a planar, phased array antenna that can receive circularly polarized and linearly polarized waves at high gain and wide bandwidth.

As the number of direct broadcast services increases world-wide, so does the need for a low-cost, compact antenna for consumer use. Currently available satellite dishes are too bulky and too expensive for many potential customers to use. A dish antenna is just a large reflector for intercepting the incoming waves and concentrating the waves at a focus where an antenna element is located. Instead of a large reflector and a single active element, the incoming electromagnetic waves can be received by a plurality of active elements and the signals from the elements are additively combined. This is done by spacing the active elements one wavelength (or an integral number of wavelengths) apart in a phased array.

At the frequency typically used by direct broadcast satellites (12 Ghz or Ku band), one wavelength is 25 mm. or about one inch. Thus, a large phased array antenna, e.g. 16×16 elements, can occupy a relatively small area, e.g. a square eighteen inches on a side. In general, the more elements, the greater the gain of the antenna, although the gain does not increase linearly with the number of elements.

The signals transmitted by satellites can be linearly polarized (horizontal or vertical) or circularly polarized (left-hand or right-hand). The particular design of a phased array antenna determines what kind of signals it will receive. For example, a relatively compact, planar, phased array used in Europe receives only right-hand, circularly polarized waves, making it unsuitable for North American and other markets, which are presently serviced by satellites transmitting linearly polarized waves.

Because of the small wavelength, the construction of phased array antennas for receiving microwaves is precise and expensive. Precision is needed because a small error can be a large fraction of a wavelength and affect the performance of the array.

In general, an antenna receiving only one type of polarization will have higher gain than an antenna receiving circular and linear polarization. Since the non-commercial consumer does not want to buy more than one antenna in order to obtain access to several satellites, one is faced with the contradictory requirements of providing a low cost, high gain antenna for receiving circularly and linearly polarized waves.

Several planar, phased array antennas have been proposed in the prior art. U.S. Pat. No. 5,270,721 (Tsukamoto et al.) describes a planar antenna including a ground plate, a plate containing the active elements in a 10×10 array and separated from the ground plate by an insulating layer, and an aperture plate separated from the elements by a second insulating layer. Each insulating layer is a foam lattice. The patent also discloses mirror-symmetric and asymmetric orientations of pairs of apertures, and corresponding orientations of pairs of antenna elements. The antenna receives only circularly polarized waves.

U.S. Pat. No. 4,857,938 (Tsukamoto et al.) discloses a planar antenna including an aperture plate having elongated, hexagonal apertures arranged in pairs and rotated ninety degrees relative to each other, and fed signals phase shifted ninety degrees relative to each other. The antenna receives only circularly polarized waves.

U.S. Pat. No. 4,816,835 (Abiko et al.) discloses a stacked radiator antenna in which two supply circuits are superimposed in order to receive both left-hand circularly polarized waves and right-hand circularly polarized waves. The power supply circuits are oriented at ninety degrees relative to each other and are separated by a grounded aperture plate. The grounded aperture plate and a radiator plate have square apertures and the radiator plate includes patch elements within the square apertures. The stack, from top to bottom, includes a radiator plate, a first power supply plate, a grounded aperture plate, a second power supply plate, and a ground conductor plate, all but the latter of which must be carefully aligned.

U.S. Pat. No. 3,587,110 (Woodward) discloses a planar array in which the conductors between pairs of elements taper and then branch to provide impedance matching in the array.

The planar phased arrays of the prior art are expensive to manufacture and do not receive both linearly polarized and circularly polarized waves. In view of the foregoing, it is therefore an object of the invention to provide a planar phased array antenna for receiving both linearly polarized and circularly polarized waves.

Another object of the invention is to provide a planar phased array antenna which is less expensive to manufacture.

A further object of the invention is to provide a planar phased array antenna which is more easily assembled than similar antennas of the prior art.

SUMMARY OF THE INVENTION

The foregoing objects are achieved in the invention in which a planar, phased array antenna includes a ground plate, a signal plate having a plurality of active elements and conductive branches electrically connecting said active elements in mirror symmetrical pairs, an aperture plate having a plurality of apertures oriented in the same direction and aligned with said active elements to provide electromagnetic coupling between each active element and the corresponding aperture, and spacers between the plates. In accordance with another aspect of the invention, the ground plate is formed on a first spacer, e.g. by screen printing, sprayed ink, or adherent conductive layer, and the aperture plate is formed on the other spacer, e.g. by screen printing, sprayed ink, or etching an adherent conductive layer. The signal plate includes an insulating substrate and a patterned conductive layer on said substrate. Alternatively, the aperture plate is separate from the other spacer and includes an insulating substrate and a patterned conductive layer on the substrate.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
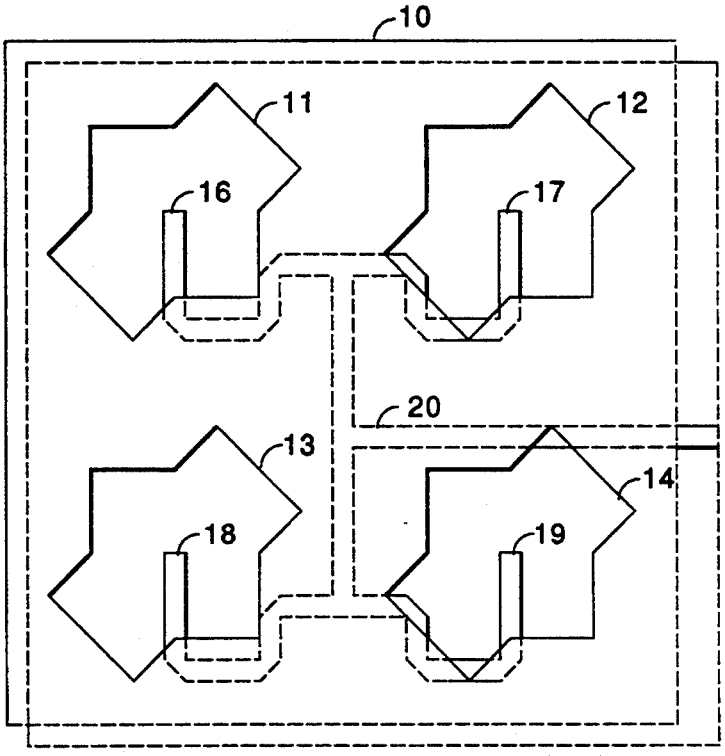
FIG. 1 (PRIOR ART)
FIG. 1 illustrates an aperture plate and active elements of a planar, phased array antenna constructed in accordance with the prior art.

FIG. 1 illustrates a phased array as described in the '721 patent in which aperture plate 10 includes a plurality of shaped apertures 11, 12, 13, and 14. Each aperture is in the shape of the combined outlines of a square and an overlying, diagonally oriented rectangle. Underneath the apertures in plate 10 are a plurality of active elements 16, 17, 18, and 19. The active elements are interconnected by conductive run 20 having equal length branches to each active element. As described in the '721 patent, the phased array illustrated in FIG. 1 can receive only circularly polarized waves.

Figure 2:
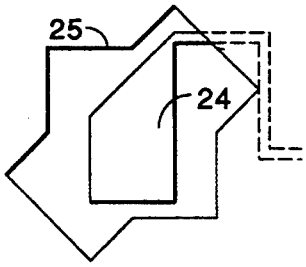
FIG. 2 (PRIOR ART)
FIG. 2 illustrates a "patch" type of active element constructed in accordance with the prior art.

The assignee of the '721 patent has sold (in Europe) an antenna having a construction similar to that described in the '721 patent but in which the active elements are constructed as illustrated in FIG. 2. Instead of being the terminal or end portion of a branch of a conductor, an active element is an enlarged, patch-like area at the end of a branch. Element 24 in FIG. 2 is trapezoidal, having the edges thereof aligned with the adjacent edges of aperture 25. Although active element 24 has a different shape from active elements 16–19, an antenna constructed as illustrated in FIG. 2 receives only circularly polarized waves.

Figure 3:
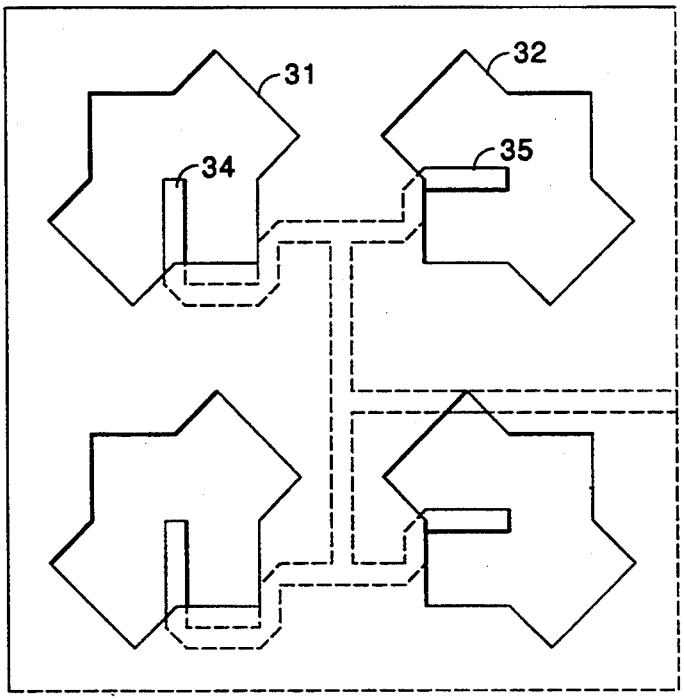
FIG. 3 (PRIOR ART)
FIG. 3 illustrates a prior art planar antenna in which alternate apertures and alternate active elements are rotated ninety degrees.

The '721 patent illustrates several different orientations for the apertures in the aperture plate and the active elements have a corresponding orientation. In FIG. 3, apertures 31 and 32 have a mirror symmetry about a line between them. Since aperture 32 is rotated ninety degrees relative to aperture 31, active element 35 is rotated ninety degrees relative to active element 34. An antenna constructed in accordance with FIG. 3 also receives only circularly polarized waves.

Figure 4:
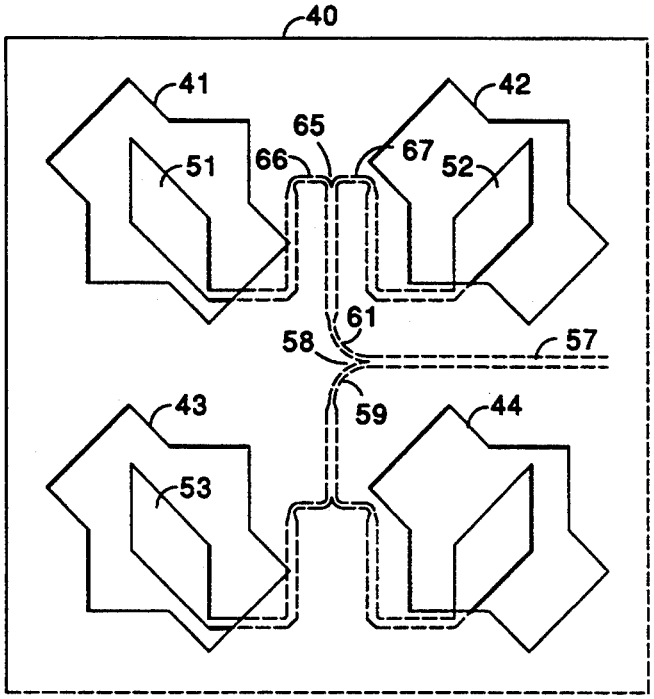
FIG. 4 illustrates a planar, phased array antenna constructed in accordance with the invention.

FIG. 4 illustrates an antenna constructed in accordance with a preferred embodiment of the invention in which aperture plate 40 includes a plurality of apertures 41, 42, 43, and 44. All of the apertures have the same shape and are oriented in the same direction. Underlying aperture plate 40 is another plate, herein referred to as the signal plate, having a plurality of active elements interconnected by a suitable conductor. Each aperture is aligned over an active element and is electromagnetically coupled to the element. Active elements 51, 52, 53, and 54 are preferably diamond shaped. (As used herein, "diamond" means a parallelogram having sides forming two inner obtuse angles or corners and two inner acute angles or corners wherein adjacent sides may or may not be equal in length).

Elements 51–54 are interconnected by conductor 57 which forms a plurality of equal length branches for connecting elements in pairs, pairs of pairs, and so on throughout the array. The end of each branch is attached to a corner of an active element. The active elements in each pair, e.g. elements 51 and 52, have a mirror symmetry about a line between them, as do active elements 53 and 54, while the corresponding apertures do not have a mirror symmetry.

Conductor 57 preferably includes LaGrange couplings in which the width of conductor 57 is split at $\tau$ 58 to form two, radiused conductors, 59 and 61, each half as wide as conductor 57. Conductor 61 enlarges into conductor 63 and is split at $\tau$ 65 to form smaller conductors 66 and 67. This type of connection continues throughout the array to eliminate discontinuities which could reflect and degrade the signals conducted from the active elements to conductor 57.

It has been discovered that this combination of apertures and active elements not only receives circularly polarized waves but also receives linearly polarized waves. In a subjective test of an antenna constructed in accordance with FIG. 4, and including a $14\times14$ array, direct broadcast satellite signals (linearly polarized) of television programs were received having a quality equal to or better than the quality of a signal received from a cable network. The antenna was housed in a square, RF transparent enclosure approximately sixteen inches on a side.

Figure 5:
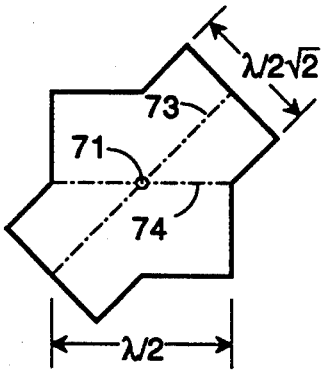
FIG. 5 (PRIOR ART)
FIG. 5 illustrates the dimensions of an aperture of the prior art.

FIG. 5 illustrates the geometry of an aperture as disclosed in the '721 patent. Aperture 11 has a geometry corresponding to the outline of a superimposed square and rectangle. Each side of the square has a length of $\lambda/2$ ($\lambda$ is the wavelength of the incident wave) and the short side of the rectangle has a length of $\lambda/2\sqrt{2}$. The long side of the rectangle has a length equal to the diagonal of the square. Center 71 is a common center of the square and the rectangle and is located at the intersection of centerlines 73 and 74, which intersect at an angle of forty-five degrees.

Figure 6:
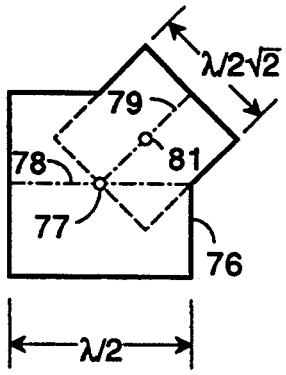
FIG. 6 illustrates the dimensions of an aperture for a preferred embodiment of the invention.

The geometry of aperture 11 is suitable for an antenna constructed in accordance with the invention. However, FIG. 6 illustrates a preferred embodiment of an aperture for an antenna constructed in accordance with the invention. As illustrated in FIG. 6, aperture 76 is the outline of superimposed squares having displaced centers. The larger square has a side of length $\lambda/2$ and the smaller square has a side of length $\lambda/2\sqrt{2}$. Center 77 is the center of the larger square and is at the intersection of centerline 78 and centerline 79 of the smaller square. Center 81 of the smaller square is displaced from center 77 along a diagonal of the larger square and the diagonals (and centerlines) of the squares intersect at an angle of approximately forty-five degrees.

Figure 7:
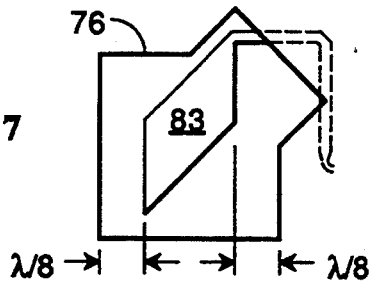
FIG. 7 shows the location of the active element relative to the aperture in accordance with a preferred embodiment of the invention.

FIG. 7 illustrates a preferred embodiment of the invention in which active element 83 is approximately centrally located within aperture 76. As illustrated in FIG. 7, the vertical edges of element 83 are separated from the nearest edge of aperture 76 by $\lambda/8$. Thus, the longer edge of element 83 has a length greater than $\lambda/4$. In the configuration shown in FIG. 7, the longer edges of the active element are parallel to the diagonal of the larger square.

Figure 8:
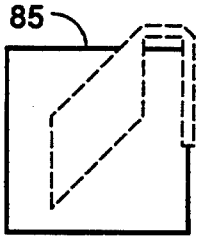
FIG. 8 illustrates an alternative embodiment of the invention for receiving linearly polarized waves.

FIG. 8 illustrates an aperture plate in accordance with an alternative embodiment of the invention in which the apertures are squares having a side equal to $\lambda/2$. This embodiment of the invention enhances the reception of either vertically or horizontally polarized waves, depending upon which way the array is oriented with respect to the satellite. In other words, if a given orientation of the antenna enables one to receive vertically polarized waves, rotating the antenna ninety degrees about an axis perpendicular to the plane of the antenna will permit one to receive horizontally polarized waves. Circularly polarized waves can be received at any rotational position of the antenna.

Figure 9:
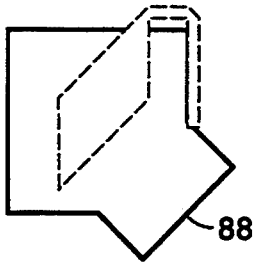
FIG. 9 illustrates an alternative embodiment of the invention for receiving left-hand, circularly polarized waves.

FIG. 9 illustrates an alternative embodiment of the invention in which aperture 88 is rotated counterclockwise ninety degrees relative to aperture 76 (FIG. 7). This embodiment of the invention receives left-hand circularly polarized waves and linearly polarized waves, whereas the embodiment of FIG. 7 receives right-hand circularly polarized waves and linearly polarized waves.

Figure 10:
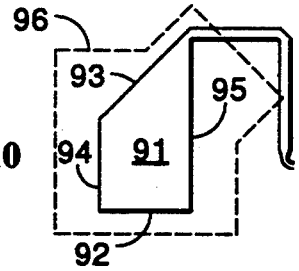
FIG. 10 illustrates an alternative embodiment of an active element in accordance with the invention.

In the embodiment of FIG. 10, active element 91 is in the shape of a trapezoid having non-parallel edges 92, 93 and parallel edges 94, 95. Edge 93 is parallel with the diagonal of the larger square. The remaining edges of the trapezoid are parallel with the adjacent edges of aperture 96. Element 91 is preferred for linearly polarized waves.

Figure 11:
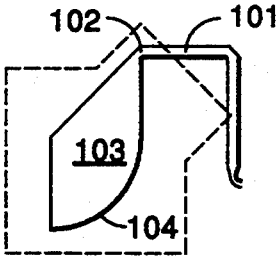
FIG. 11 illustrates an alternative embodiment of an active element in accordance with the invention.
Figure 12:
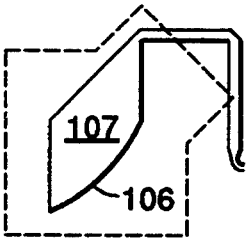
FIG. 12 illustrates an alternative embodiment of an active element in accordance with the invention.

FIGS. 11 and 12 illustrate an alternative embodiment of the invention in which one edge of the active element is curved. In FIG. 11, branch 101 is attached to corner 102 of active element 103 and one of the sides opposite corner 102 is a convex curve of radius R, wherein $\lambda/4 \leqq R \leqq \lambda/2$. Edge 104 of element 103 is a convex curve whose radius is equal to $\lambda/4$. In FIG. 12, edge 106 of element 107 is a convex curve having a radius equal to $\lambda/2$. Having an edge of the diamond in the shape of a convex curve improves the reception of circularly polarized waves.

Figure 13:
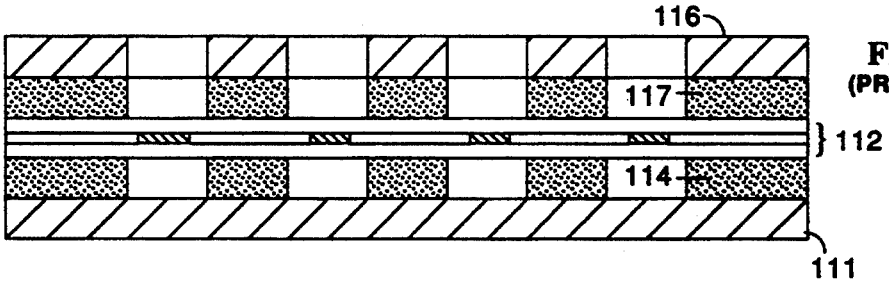
FIG. 13 (PRIOR ART)
FIG. 13 is a cross-section of an antenna constructed in accordance with the prior art.

FIG. 13 illustrates the construction of an antenna as described in the '721 patent. Ground plate 111 is made from aluminum or other suitable conductor and is separated from signal plate 112 by dielectric foam layer 114. Aperture plate 116 is separated from signal plate 112 by dielectric foam layer 117. Signal plate 112 includes three layers, a substrate, a conductive layer screen printed on the substrate and a protective plastic film overlying the conductive layer. Each of these plates is costly to manufacture and, except for ground plate 111, the plates must be aligned with care in assembling the antenna.

Figure 14:
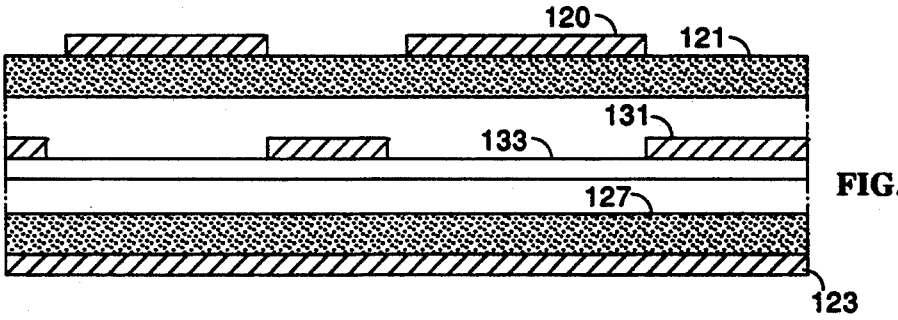
FIG. 14 is a cross-section of an antenna constructed in accordance with the invention.

In accordance with another aspect of the invention, the antenna is constructed more simply and at lower cost than planar, phased array antennas of the prior art. As illustrated in FIG. 14, a planar, phased array antenna is constructed in a less costly fashion by forming aperture plate 120 on spacer 121, e.g. by screen printing. Aperture plate 120 is preferably a silver ink approximately one mil thick. Other conductive inks can be used instead and aperture plate 120 can be formed by spraying through a mask or etching an adherent conductive layer. Ground plate 123 is screen printed onto the underside of spacer 127. The spacers are preferably solid, i.e. do not have apertures, and are preferably a sheet of dielectric foam approximately eighty-five mils thick (for Ku band operation).

The signal plate includes patterned, conductive layer 131 on insulating substrate 133, which is preferably made from polyester or Mylar. Conductive layer 131 is preferably a thin copper layer, e.g. one half mil thick, attached to substrate 133 and patterned to form the elements and the interconnecting conductors. No protective layer is necessary and the active elements are aligned with the apertures, e.g. by fiduciary marks on the plates or by alignment pins through the plates. The plates are enclosed in an RF transparent case (not shown) and attached to a "low noise block" (not shown) which couples the antenna to a receiver.

Figure 15:
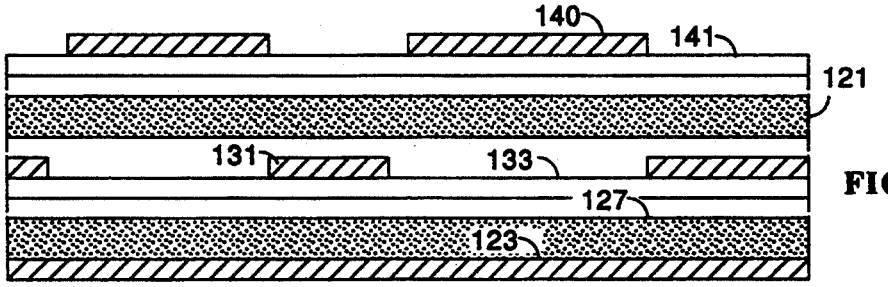
FIG. 15 is a cross-section of an antenna constructed in accordance with an alternative embodiment of the invention.

FIG. 15 is a cross-section of an antenna constructed in accordance with an alternative embodiment of the invention in which the aperture plate is made by patterning a conductive layer on an insulating substrate such as Mylar or polyester. The antenna shown in FIG. 15 is otherwise identical to the antenna illustrated in FIG. 14. At higher wavelengths, etching can provide better dimensional control than screen printing. Either etching or screen printing avoids the distortion or rough edges that can occur when punching holes in a conductive sheet to make an aperture plate.

An antenna constructed in accordance with the invention can be made at relatively low cost and produces a signal equal to or better than a signal from a cable service. A consumer has access to direct broadcast satellites with a small, inconspicuous, planar array which can receive both circularly polarized and linearly polarized waves.

Having thus described the invention, it will be apparent to those of skill in the art that various modifications can be made within the scope of the invention. For example, while described in the context of an antenna for receiving direct broadcast signals, it is understood that an antenna constructed in accordance with the invention can be used for transmitting signals.

What is claimed is:

1. A planar, phased array antenna comprising:

a ground plate;

a signal plate including (a) a plurality of active elements, wherein each active element is in the shape of a parallelogram having parallel, opposed edges, and (b) conductive branches electrically connecting said active elements in mirror symmetrical pairs, wherein each conductive branch is connected to a corner of an active element;

a first spacer between said ground plate and said signal plate;

an aperture plate having a plurality of apertures oriented in the same direction and aligned with said active elements, wherein each aperture is electromagnetically coupled to an active element;

a second spacer between said aperture plate and said signal plate;

wherein the opposed edges of one active element in each pair of active elements are parallel to a diagonal of the aperture to which the one active element is electromagnetically coupled; and the corresponding opposed edges of the other active element in each pair is perpendicular to the corresponding diagonal of the aperture to which the other active element is electromagnetically coupled.

2. A planar, phased array antenna comprising;

a ground plate;

a signal plate including (a) a plurality of active elements, wherein each active element is in the shade of a parallelogram having parallel, opposed edges, and (b) conductive branches electrically connecting said active elements in mirror symmetrical pairs, wherein each conductive branch is connected to a corner of an active element;

a first spacer between said ground plate and said signal plate;

an aperture plate having a plurality of apertures oriented in the same direction and aligned with said active elements, wherein each aperture is electromagnetically coupled to an active element;

second spacer between said aperture plate and said signal plate;

wherein one of the edges opposite said corner of each element is a curve of radius R, wherein $\lambda/4 \leqq R \leqq \lambda/2$.

3. The antenna as set forth in claim 1 wherein said first spacer and said second spacer are each a sheet of dielectric foam.

4. The antenna as set forth in claim 1 wherein said first spacer and said second spacer are solid sheets of dielectric foam.

5. A planar, phased array antenna comprising:

a ground plate;

a signal plate including (a) a plurality of active elements, wherein each active element is a polygon, and (b) conductive branches electrically connecting said active elements in mirror symmetrical pairs, wherein each conductive branch is connected to a corner of an active element;

a first spacer between said ground plate and said signal plate;

an aperture plate having a plurality of apertures oriented in the same direction and aligned with said active elements, wherein each aperture is electromagnetically coupled to an active element;

a second spacer between said aperture plate and said signal plate;

wherein each aperture is in the shape of the outline of superimposed first and second squares;

said first square is larger than said second square;

the center of said second square is located along a diagonal of said first square and is displaced from the center of said first square; and the diagonals of said first square and said second square intersect at an angle of approximately forty-five degrees.

6. The antenna as set forth in claim 5 wherein the sides of said first square have a length equal to $\lambda/2$ and the sides of said second square have a length equal to $\lambda/2\sqrt{2}$.

* * * * *